United States Patent [19]

LaDue et al.

[11] 4,074,672

[45] Feb. 21, 1978

[54] SHUTOFF APPARATUS FOR INTERNAL COMBUSTION ENGINES

[75] Inventors: Donn LaDue, Hollywood; Robert J. Winchurch; Gary R. Scaife, both of Los Angeles, all of Calif.

[73] Assignee: S & S Research and Electronics, Tarzana, Calif.

[21] Appl. No.: 651,850

[22] Filed: Jan. 23, 1976

[51] Int. Cl.[2] ..... F02B 77/08

[52] U.S. Cl. ..... 123/198 DC; 307/10 AT; 340/64; 340/57; 340/52 F; 123/198 DB

[58] Field of Search ..... 123/148 S, 198 B, 198 DC, 123/19 D, 146.5 C; 180/82 R; 340/64, 57, 52 F; 307/10 R, 10 AT

[56] References Cited

U.S. PATENT DOCUMENTS

| | | | |
|---|---|---|---|
| 3,194,970 | 7/1965 | Claps | 307/10 AT |
| 3,362,388 | 1/1968 | Lindberg et al. | 123/146.5 C |
| 3,601,103 | 8/1971 | Swiden | 123/198 DC |
| 3,675,036 | 7/1972 | Davies | 123/148 S |
| 3,680,539 | 8/1972 | Savage et al. | 123/148 S |
| 3,720,284 | 3/1973 | Myers | 123/148 S |
| 3,745,985 | 7/1973 | Hohne | 123/148 S |
| 3,914,735 | 10/1975 | Guillaume | 123/198 D |

*Primary Examiner*—Samuel Feinberg
*Attorney, Agent, or Firm*—Huebner & Worrel

[57] ABSTRACT

The invention includes circuitry adapted to be interconnected with the ignition system of spark-fired internal combustion engines. The circuit created is adapted to shut off the engine by preventing induction coil voltage buildup by grounding the secondary circuit of the coil when the engine overheating switch closes or, in the alternative, when an antitheft switch similarly positioned in the circuit is closed. The engine shutoff provided is in addition to the signal light which when energized indicates that the engine is overheating.

A method of preventing voltage buildup in the induction coil by grounding the secondary circuit of the coil in an ignition system when the heat sensing switch, or a normally open antitheft switch, is closed.

32 Claims, 2 Drawing Figures

SHUTOFF APPARATUS FOR INTERNAL COMBUSTION ENGINES

BACKGROUND OF THE INVENTION

In standard ignition systems in automobiles there is provided a heat sensing switch, generally in the form of a thermocouple, which closes when the water temperature of the engine heats to a temperature of approximately 220° F., and this results in a red light on the dashboard being energized to indicate that the engine is overheating. As the result of the addition of antismog devices in automobiles, engines overheat much more frequently in hot, humid weather than in the past. This type of overheating has become a severe problem in rental cars where the lessee is not as careful with the equipment as he probably would be with his own. In any event, rental car owners have experienced substantial expenses in excessive repairs to overheated motors which were driven after the warning lights indicated that they were overheating.

Because of the great expense involved since the advent of the antismog devices, attempts have been made to eliminate the overheating problem. This problem has been solved by the present invention which, in addition to warning signals, provides means to shut off the engine before it overheats enough to cause damage.

In view of the automobile theft problem, the present invention has been adapted to be applied with the addition of an antitheft switch. The antitheft switch, like the heat sensing switch, is a normally open switch but is hand operated, whereas the heat sensing switches are automatically closed at a predetermined temperature. The antitheft switches may be installed independently of the heat sensing switch or may be installed in parallel with the heat sensing switch, in which situation they are independently operable to shut off an internal combustion engine.

SUMMARY OF THE INVENTION

Accordingly, it is an object of the invention to provide improved circuitry interconnected into the ignition systems of spark-fired internal combustion engines, which after a predetermined delay will shut off the engine. In the case of the overheating application, the engine will start again only after the heat sensing switch opens automatically after the engine has cooled. In the case of the antitheft switch, which is hand operated, the engine will start when the switch is closed and will run for a short period during the predetermined delay time and then shut off. Because of the circuit arrangement the engine will not start again because the secondary circuit of the induction coil remains grounded after the engine has shut off.

It is another object of the invention to provide a simple, substantially solid state circuit, connectable to the ignition wiring, and which will greatly reduce the damage from engine overheating in automobiles, particularly in rental cars. The present invention is adapted to substantially reduce the repair costs of rental automobiles, the costs of overheating repairs of such automobiles in hot, humid climates being about 35% of the total rental car repair costs. The minimum cost of repairing an overheated engine is about $150.00 and many repairs run substantially higher, in the order of $650.00 per car.

It is a further object of the invention to provide antitheft circuitry for automobile ignition systems which assures permanent engine shutoff shortly after the engine is started.

It is a still further object of the invention to provide a method for shutting off an internal combustion engine when a normally open switch in the ignition system is closed.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustative purposes.

DESCRIPTION OF THE PREFERRED EMBODIMENTS

Figure 1:
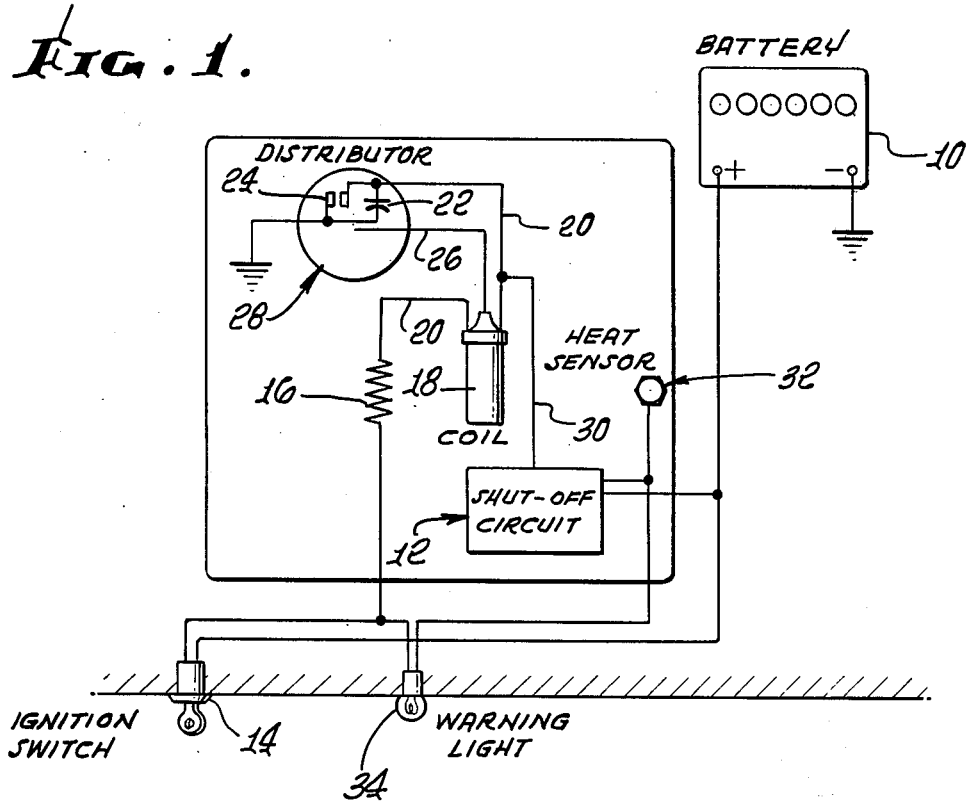
FIG. 1 is a diagramatic view of standard internal combustion engine ignition circuitry with the shutoff circuit according to the invention installed.

Referring again to the drawings, there is shown in FIG. 1 a typical 12 volt automobile battery 10 having its negative side connected to ground in the automobile and having its positive side connected to an engine shutoff circuit, generally designated as 12, and to an ignition switch 14. The ignition circuitry includes a ballast resistor 16 connected to a primary circuit 20 of the induction coil 18, the resistor being adapted to reduce the voltage to the coil. Internally, the coil has a typical secondary circuit. The primary circuit 20 is connected to a timer, comprised of a capacitor 22 and an engine operated timing switch 24. The timing circuit terminates in a ground conection. A high voltage line 26 from the coil is connected to a distributor 28 through which the high voltage is supplied to each spark plug to cause it to fire.

The shutoff circuit 12 is connected by a lead 30 to the primary circuit 20. A standard heat sensor thermal, or sensing, switch 32 which closes at a predetermined excessive temperature, such as 220° F., is connected to the shutoff circuit, as is the dashboard warning light or signal means 34 energized by the closing of the heat sensing switch.

Figure 2:
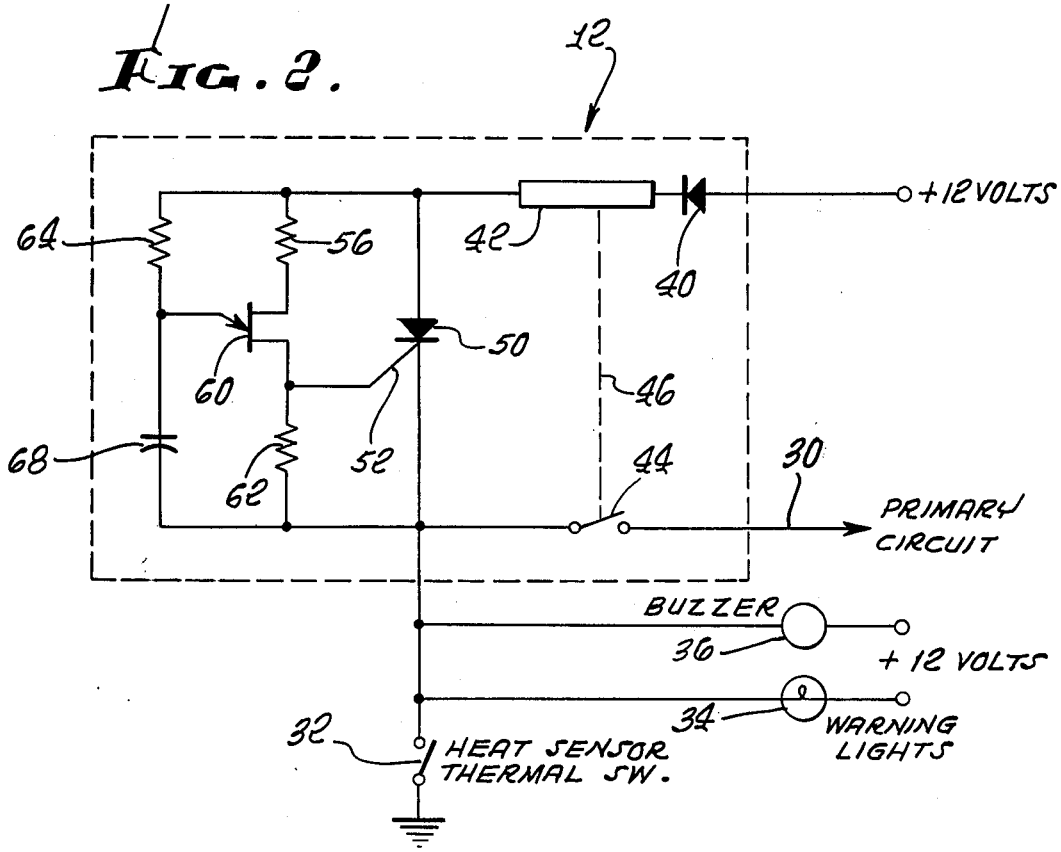
FIG. 2 is a detailed view of the shutoff circuit shown in box form in FIG. 1.

In FIG. 2 the heat sensing switch 32 is shown in its normally open position, adapted to provide a path to ground when closed. The warning light 34 is shown connected to the battery so as to be energized when the switch is closed, and an additional warning buzzer 36 is also connected to be energized when the switch 32 is closed. The seat belt buzzer in modern cars may be additionally connected, as shown here, to function also as an overheating warning signal.

The shutoff circuit 12 shown in the box in FIG. 1 is shown within the rectangle formed of broken lines. The shutoff circuit is connected to the battery, as shown in FIG. 1, and a diode 40 is provided to protect the ignition circuitry by permitting current only from the negative to the positive. This diode may be a type 1N 4004.

A 12 volt electromagnetic switch 42 is provided in the circuit and is comprised of a relay which when energized closes the contacts or switch 44, shown to be connected mechanically to the relay by broken lines 46. In the ground path, when the switch 32 is closed, a silicon control rectifier 50, having a sensitive gate 52, is fired by 2½ volts. The rectifier is a type 2N 5060.

In parallel with the rectifier is a stabilizing and biasing circuit connected to the gate. This circuit is comprised of a 1000 ohm, ½ W temperature compensating resistor 56, a unijunction transistor 60, type 2N 4871, which operates with about 8 volts, and a 27 ohm, ½ W ballast resistor 62, which is adapted to reduce the voltage to the gate to approximately 2½ volts. Connected in parallel to the transistor is a predetermined time delay circuit comprised of a 470K ohm, ½ W, 22 seconds delaying resistor 64 and a 22 microfarad capacitor 68 in which the voltage is built up during the delay of the current through the resistor 64 to approximately 8 volts to operate the transistor 60.

In the normal operation of the ignition system, the timing switch 24 is opened mechanically by the engine to open the primary circuit, the induction coil then generating a high voltage sufficient to cause a spark to momentarily jump the spark plug gap in each cylinder. These high voltage impulses travel through the secondary circuit of the coil and the high voltage line 26 to the distributor which shunts each impulse to a cylinder ready to receive the ignition action. When the heat sensing switch 32 is closed, providing a path from ground to the SCR 50, the buzzer 36 and light 34 will be energized to provide warning signals. Before the SCR is fired, sufficient voltage will not travel therethrough to actuate the switch 42.

In order to prevent the immediate closing of the circuit, and shut off of the engine, the current flow through the resistor 64 is delayed approximately 22 seconds so as to slowly build up the voltage in the capacitor 68 to an amount sufficient to operate the transistor 60. When the transistor is operated, the resistor 56 functions to stabilize the circuit and compensate for any temperature variations, and the resistor 62 reduces the voltage to approximately 2½ volts to the gate 52 which fires the SCR to permit 12 volts negative to flow therethrough to actuate the electromagnetic switch 42, whereby the contacts 44 are closed to permit 12 volts negative to be continuously applied to the primary circuit of the induction coil so as to ground the coil, shunting the primary circuit. This continuous voltage nullifies the opening of the timing switch 24, preventing the voltage buildup and the firing of the spark plugs so as to stop the engine. At this time the ignition switch would be typically turned off, and if turned on again the engine could not be started if the heat sensing switch 32 is closed. Thus, for practical purposes, as long as the heat sensing switch is closed the automobile could not be operated.

Figure 3:
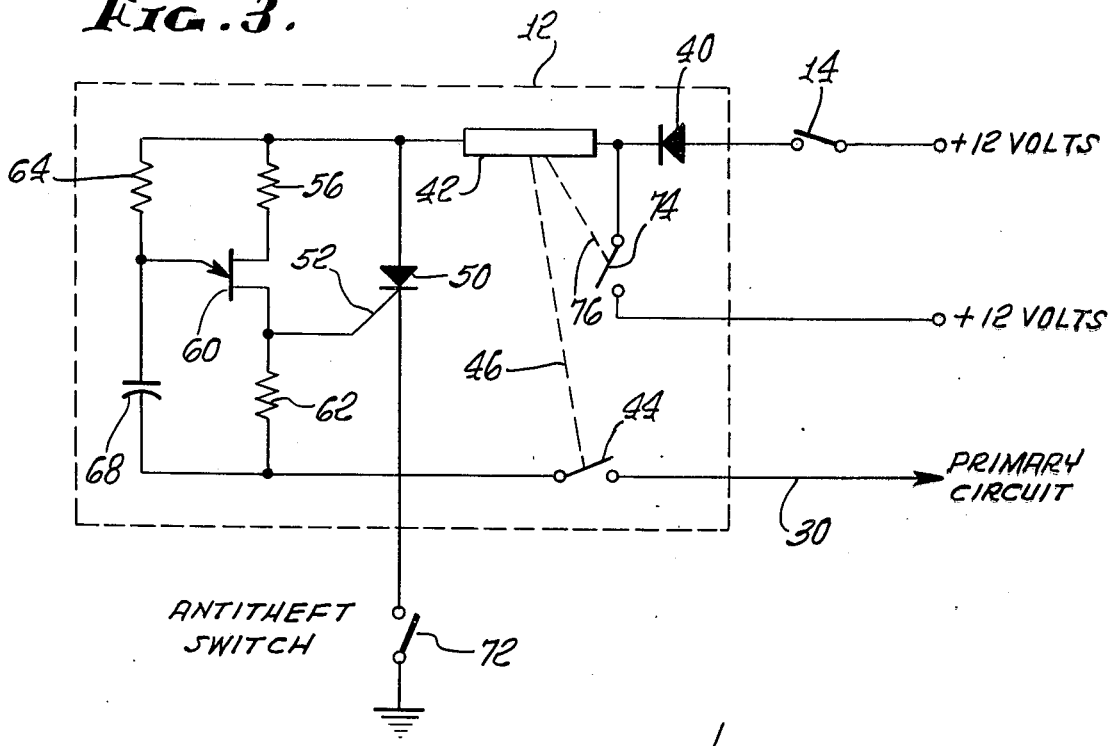
FIG. 3 is a modified form of the shutoff circuit adapted for use with an antitheft switch.

In FIG. 3 a hand operable antitheft switch 72 is positioned in the circuit in the same position as the heat sensing switch in FIG. 2. In this embodiment the heat sensing switch is not shown in the shutoff circuitry. Here, the relay 42 has an additional pair of contacts or switch 74, the mechanical operation of the switch being indicated by the broken line connection 76. The contacts 74 are connected directly to the 12 volt battery.

In operation the antitheft switch is closed when the automobile is parked and should be in a position not easily found or easily accessible to a potential thief. When the ignition switch 14 is closed the car will start in the usual manner, and after the 22 second delay effected by the resistor 64 the secondary circuit will be grounded and the automobile engine will stop. Because the contacts 44 and 74 are then closed at the time the engine is shut off, they will remain closed because the contacts 74 are directly connected to the battery even though the ignition switch be opened in the usual manner to attempt to restart the car. Therefore, as long as the antitheft switch remains closed after the initial starting, the engine cannot be started again until it is opened by hand.

Figure 4:
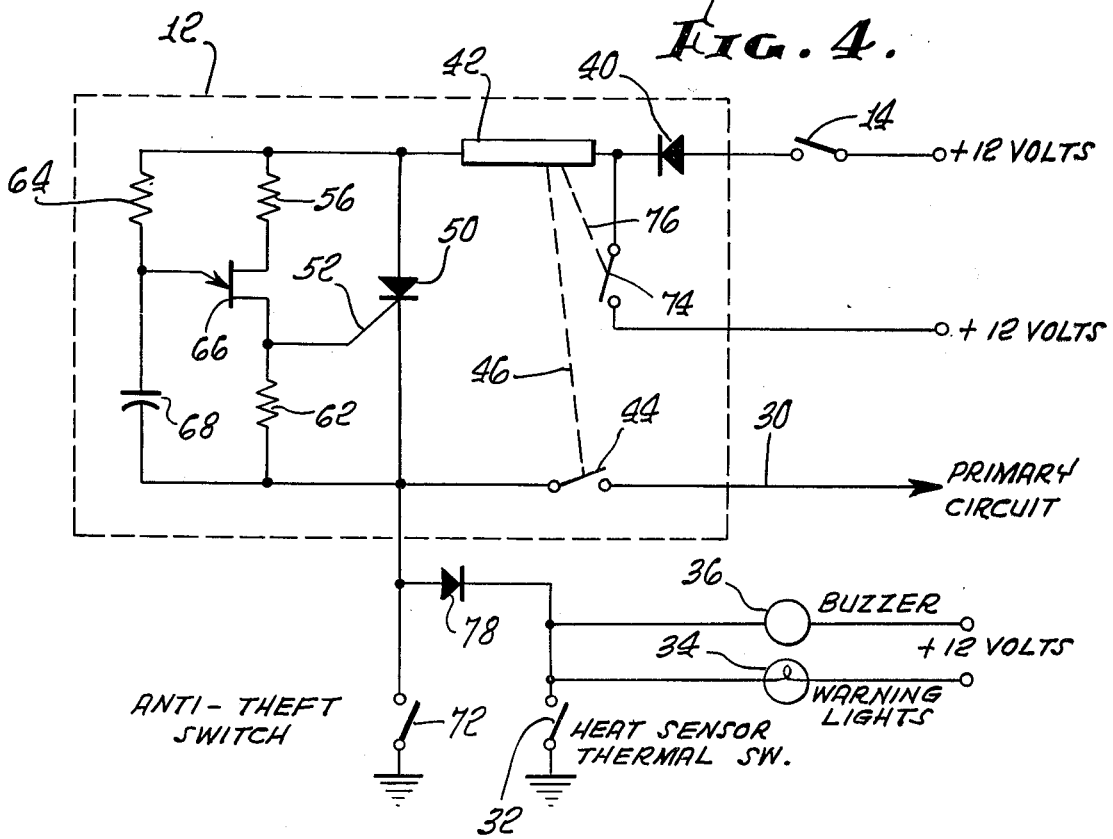
FIG. 4 is another form of circuit adapted for use with an antitheft switch and a heat sensing switch.

In FIG. 4 the circuitry is shown with the antitheft switch 72 and the heat sensing switch 32 coupled in parallel with a diode 78 positioned to prevent the energizing of the buzzer 36 and the warning lights 34 when the antitheft switch is closed and the engine is started, the heat sensing switch 32 being open. In this embodiment when the antitheft switch is closed, the circuit will function in the same manner as that shown in FIG. 3, no current flowing through the diode 78.

When the antitheft switch is open and the heat sensing switch closes as the result of overheating of the engine, the warning light and buzzer will be energized in the same manner as in the embodiment shown in FIG. 2, the current flowing through the diode and through the SCR to stop the engine after the 22 second delay. When the heat sensing switch 32 is opened later due to cooling of the engine, it can again be started because the contacts 44 and 74 will also be open as a result of the breaking of the circuit by the opening of the switch 32.

From the foregoing it is clear that the present invention provides a simple circuitry and method for positively shutting off internal combustion engines to prevent theft and to prevent overheating of the engine.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. We do not wish to be restricted to the specific forms shown or uses mentioned except as defined in the accompanying claims, wherein various portions have been separated for clarity of reading and not for emphasis.

We claim:

1. A circuit for grounding an induction coil in an ignition system, said circuit comprising:

a normally open switch for providing a path to ground when closed and for energizing the circuit and for causing the coil to be grounded when closed, a delay portion of the circuit having a first resistor to delay voltage buildup a predetermined amount and having a capacitor in series with said first resistor, a biased and stabilizing portion of the circuit in parallel with said delay portion and having a unijunction transistor connected to said delay portion to the operated after said delay, an SCR being in series with said normally open switch when closed, said SCR having a gate, said transistor being adapted to provide reduced voltage to the gate to fire said SCR when said normally open switch is closed and after said delay, and a relay in series with said SCR and being adapted to close a relay operated first switch to close the circuit to ground said coil.

2. The invention according to claim 1 including:
a second switch operated by said relay, and being in parallel with said first switch,
said second switch being directly connected to the ignition system power source so as to be adapted to continue to ground the coil after being closed when the ignition switch is open.

3. The invention according to claim 1 including:
a second normally open switch for providing a path to ground when closed and for causing the coil to be grounded when closed independently of the first normally open switch.

4. A method of grounding an induction coil in an ignition system of an internal combustion engine, said method comprising:
closing a normally open switch in the ignition circuit, said switch providing a path to ground,
delaying the voltage buildup a predetermined amount after said switch is closed,
supplying the built up delayed voltage to a biased transistor,
supplying reduced voltage from the transistor to a gate to fire an SCR in series with said normally open switch,
firing the SCR to actuate a relay to close a switch operated by the relay, and
supplying negative voltage through the closed normally open switch and through the closed relay switch to the primary circuit of the induction coil to ground the coil.

5. In an ignition system for spark-fired internal combustion engines, engine shutoff apparatus including ignition circuitry having an ignition switch, an induction coil having a primary and a secondary circuit, a timer having a switch and capacitor, a distributor and an electric power source,
the improvement comprising:
a normally open switch providing a path to ground when closed, and
means coupled to said circuitry to ground the induction coil by a continuous voltage when the switch is closed,
said normally open switch being a hand-operable switch,
said means coupled to said ignition circuitry including switch means that close when said normally open switch is closed, and said means coupled being energized by the ignition circuitry, whereby the induction coil is grounded by a continuous voltage,
said switch means being connected to said source after closing when the ignition switch is opened after the coil is grounded to continue the grounding of the induction coil,
said switch means being first and second relay operated switches,
said first relay operated switch being directly connected to the source when closed and said second relay operated switch being directly connected to the coil when closed.

6. In an ignition system for spark-fired internal combustion engines, engine shutoff apparatus including ignition circuitry having an ignition switch, an induction coil having a primary and a secondary circuit, and an electric power source,
the improvement comprising:
a normally open switch providing a path to ground when closed,
means coupled to said circuitry being adapted to ground the ignition circuitry when the normally open switch is closed,
said means coupled including a time delayed switch that closes at a predetermined time after said normally open switch closes to connect said means coupled with said ignition system so that an engine will not start while said normally open switch is closed, and
delay means within said means coupled to delay the closing of said time delayed switch said predetermined amount of time after the normally open switch is closed.

7. A circuit for shunting an induction coil in an ignition system, said circuit comprising:
a normally open switch for providing a path to ground when closed and for energizing the circuit and for causing the coil to be shunted when closed,
a delay portion of the circuit having first means to delay voltage buildup a predetermined amount and having second means, in which voltage is built up, in series with said first means,
a biased and stabilizing portion of the circuit in parallel with said delay portion and having third means connected to said delay portion to be operated after said delay,
a gated switch being in series with said normally open switch when closed,
said third means being adapted to provide reduced voltage to fire said gated switch when said normally open switch is closed and after said delay, and
means in series with said gated switch and being adapted to close a first switch to close the circuit to shunt said coil.

8. The invention according to claim 7 in which:
said first means is a resistor.

9. The invention according to claim 7 in which:
said second means is a capacitor.

10. The invention according to claim 7 in which:
said third means is a unijunction transistor.

11. The invention according to claim 7 in which:
said gated switch is a rectifier having a gate.

12. The invention according to claim 7 in which:
said gated switch is an SCR having a gate.

13. The invention according to claim 7 in which:
said means in series with said gated switch is a relay adapted to close a relay-operated said first switch.

14. The invention according to claim 13 including:
a second switch operated by said means in series with said gated switch, and being in parallel with said first switch,
said second switch being directly connected to the ignition system power source so as to be adapted to continue to shunt the coil after being closed when the ignition switch is open.

15. The invention according to claim 7, including:
a second normally open switch for providing a path to ground when closed and for causing the coil to be shunted when closed independently of the first normally open switch.

16. A method of shunting an induction coil in an ignition system of an internal combustion engine, said method comprising:
closing a normally open switch in the ignition circuit, said switch providing a path to ground,
delaying the voltage buildup a predetermined amount after said switch is closed, supplying the built up delayed voltage to a biased means, supplying reduced voltage from the biased means to fire a gated switch in series with said normally open switch, firing the gated switch to actuate means to close a switch operated by said last means, and supplying negative voltage through the closed normally open switch and through the last means closed switch to the primary circuit of the induction coil to shunt the coil.

17. In an ignition system for spark-fired internal combustion engines, engine shutoff apparatus including ignition circuitry having an ignition switch, an induction coil having a primary and a secondary circuit, and an electric power source, the improvement comprising:

a normally open switch providing a path to ground when closed, and means coupled to said circuitry to shunt the primary circuit to cause overtension to occur across the primary circuit of the coil when the normally open switch is closed, said means coupled including a time delay means which functions at a predetermined time after said normally open switch is closed to interlock said means coupled with said ignition system so that an engine will not start while said normally open switch is closed, said means coupled being comprised of elements coupled and arranged so that failure of function of any or all of them being adapted to permit continued normal operation of the ignition system.

18. In an ignition system for spark-fired internal combustion engines, engine shutoff apparatus including ignition circuitry having an ignition switch, an induction coil having a primary and a secondary circuit, and an electric power source, the improvement comprising:

a normally open switch providing a path to ground when closed, means coupled to said circuitry being adapted to shunt the primary circuit when the normally open switch is closed, said means coupled including a first time delay switch which closes at a predetermined time after said normally open switch closes to interlock said means coupled with said ignition system so that an engine will not start while said normally open switch is closed, and delay means within said means coupled to delay the closing of said first time delayed switch said predetermined amount of time after the normally open switch is closed.

19. The invention according to claim 18 in which:

said means coupled includes means to supply power from the source to the primary circuit of the coil.

20. The invention according to claim 18 in which:

said normally open switch is a heat sensing switch adapted to be closed by overheating of the engine at a predetermined temperature.

21. The invention according to claim 18 in which:

said normally open switch is a hand-operable anti-theft switch.

22. The invention according to claim 18 including:

a second normally open switch coupled to said means coupled, said second switch when closed being connected to shunt said primary circuit independently of said first normally open switch.

23. The invention according to claim 18 in which:

said means coupled to said ignition circuitry includes said first time delayed switch and a second time delayed switch that close when said normally open switch is closed and said means coupled is energized by the ignition circuitry, whereby the primary circuit is shunted by a continuous voltage, said first and second time delayed switches being connected to said source after closing when the ignition switch is opened after the primary circuit is shunted to continue the shunting of the primary circuit.

24. The invention according to claim 23 in which:

said first and second time delayed switches are first and second relay operated switches, said first relay operated switch being directly connected to the source when closed and said second relay operated switch being directly connected to the primary circuit when closed.

25. The invention according to claim 18 in which said means coupled includes:

said delay means being a predetermined time delay circuit portion adapted to delay voltage buildup therein, a biased stabilizing and temperature compensating circuit portion coupled to be energized by said delay circuit and having means adapted to reduce the voltage to a gated switch connected thereto, said gated switch being fired by the reduced voltage to connect the closed normally open switch to said first time delayed switch, said first time delayed switch being energized by source voltage through said closed gated switch being adapted to apply negative source voltage from said means coupled to the primary circuit.

26. The invention according to claim 25 in which:

said time delay portion is comprised of a high value time delay resistor and a capacitor in series, said biased portion being in parallel with said delay circuit portion and having a stabilizing resistor, a unijunction transistor and voltage reducing resistor in series.

27. The invention according to claim 26 including:

a diode for preventing current flow from said source to said means coupled.

28. The invention according to claim 27 including:

signal means coupled to said ignition circuitry and actuated by the closing of said normally open switch.

29. The invention according to claim 22 in which said means coupled includes:

said delay means being a predetermined time delay circuit portion adapted to delay voltage buildup therein, a biased stabilizing and temperature compensating circuit portion coupled to be energized by said delay circuit and having means adapted to reduce the voltage to a gate connected thereto, an SCR having said gate, the SCR being fired by the reduced voltage to connect a closed normally open switch to said first time delayed switch which is a first electromagnetic switch, said first electromatic switch when energized by negative source voltage through said SCR being adapted to apply negative source voltage from said coupled to said coil, said first electromatic switch being a relay, operating a first relay switch, said means coupled being connected to said primary circuit when said first switch is closed.

30. The invention according to claim 29 in which:

said relay is adapted to operate a second relay switch, said second relay switch being coupled directly to said source when closed, whereby when said relay is energized said coil is continuously shunted while either of said normally open switches is closed and when said ignition switch is open or closed.

31. The invention according to claim 29 including:

signal means coupled to said ignition circuitry and being actuated by the closing of one of said normally open switches.

32. The invention according to claim 31 including:

means between said normally open switches to prevent the closing of the other normally open switch from actuating said signal means.

* * * * *